US012221277B2

(12) United States Patent
Thiessen

(10) Patent No.: US 12,221,277 B2
(45) **Date of Patent: *Feb. 11, 2025**

(54) HYDROCARBON STORAGE VESSEL WITH INTEGRAL CONTAINMENT

(71) Applicant: 2376016 Alberta Inc., Calgary (CA)

(72) Inventor: Tylan Thiessen, Neilburg (CA)

(73) Assignee: 2376016 Alberta Inc., Neilburg (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/505,281

(22) Filed: Nov. 9, 2023

(65) Prior Publication Data

US 2024/0076121 A1 Mar. 7, 2024

Related U.S. Application Data

(63) Continuation of application No. 17/089,998, filed on Nov. 5, 2020, now Pat. No. 11,919,705.

(60) Provisional application No. 62/935,454, filed on Nov. 14, 2019.

(51) Int. Cl.
*B65D 88/74* (2006.01)
*B65D 88/54* (2006.01)

(52) U.S. Cl.
CPC ..... *B65D 88/748* (2013.01); *B65D 88/54* (2013.01)

(58) Field of Classification Search
CPC ..... B65D 88/74; B65D 88/54; B65D 90/20; F24H 9/12; F24H 1/18; F24H 9/146; A47J 27/026; F28D 1/0213
USPC ..... 220/567; 165/132, 80.1, 920
See application file for complete search history.

(56) References Cited

U.S. PATENT DOCUMENTS 5,269,217 A * 12/1993 Goad ..... A47J 27/18 126/369
5,381,729 A * 1/1995 Hennessy ..... H05B 3/82 126/369
2014/0245972 A1* 9/2014 Thiessen ..... F24H 9/1836 392/456
2015/0329285 A1* 11/2015 Hanson ..... B65D 81/18 220/592.2

* cited by examiner

*Primary Examiner* — Anthony D Stashick
*Assistant Examiner* — Raven Collins
(74) *Attorney, Agent, or Firm* — Ryan W. Dupuis; Michael R. Williams; Ade & Company Inc.

(57) ABSTRACT

A hydrocarbon fluid storage structure has a storage vessel containing hydrocarbon fluids therein and a containment vessel fully surrounding the storage vessel so as to provide secondary containment to the storage vessel. A heater is surrounded by heat exchanger fluid within a heat exchanger vessel within the storage vessel. The exterior of the containment vessel is insulated. The heat exchanger fluid is passively circulated within a closed loop path defined by the heat exchanger vessel. Connecting valves providing external access to the contents of the storage vessel are received within a valve housing in heat exchanging relation with a containment space between the containment vessel and the storage vessel.

10 Claims, 4 Drawing Sheets

HYDROCARBON STORAGE VESSEL WITH INTEGRAL CONTAINMENT

This application is a continuation of US parent application Ser. No. 17/089,998, filed Nov. 5, 2020, and claims the benefit under 35 U.S.C. 119(e) of U.S. provisional application Ser. No. 62/935,454, filed Nov. 14, 2019.

FIELD OF THE INVENTION

The present invention relates to a storage vessel arranged to receive hydrocarbon fluids therein, for example produced fluids from a wellbore, and more particularly relates to a hydrocarbon storage vessel contained within a surrounding containment vessel to provide secondary containment to the hydrocarbon fluids. The present invention further relates to a hydrocarbon storage vessel receiving a heater therein to maintain fluidity and/or assist gravity separation of the hydrocarbon fluids within storage vessel.

BACKGROUND

In the handling of hydrocarbon fluids, for example fluids produced from a wellbore, it is known to store the fluids in storage tanks which require some form of secondary containment to prevent escape of the fluids into the environment in the event of a leak in the storage tank. It is also known to provide a heater of some form within the tank to maintain fluidity of the hydrocarbon fluids which may include a mixture of liquids, gases, and solids at some temperatures. Due to the requirements for various valve connections for filling and unloading the tanks as well as connections for a heater, it is common to provide storage tanks for hydrocarbon fluids within a dike structure to provide secondary containment while maintaining accessibility for valves and a heater. In colder environments, the valves supported externally of the tank may become frozen and difficult to operate. The dike structure as a secondary containment requires considerable time and effort to set up and is therefore not easily portable with the storage tanks.

U.S. Pat. No. 5,570,714 by Magish, U.S. Pat. No. 5,071,176 by Marino, and U.S. Pat. No. 5,530,052 by Harp disclose various examples of a storage structure in which a storage tank is received within a secondary containment tank to provide secondary containment to the fluids within the storage tank. The secondary containment tanks in the prior art do not accommodate for a heater, nor provide ready access to connection lines at ground level for ease of loading and unloading of the storage tank.

SUMMARY OF THE INVENTION

According to one aspect of the invention there is provided a hydrocarbon fluid storage structure for storing hydrocarbon fluids therein, the structure comprising:

- a base frame;
- a storage vessel supported on the base frame so as to be arranged to contain hydrocarbon fluids therein;
- a heater in communication with the storage vessel so as to be arranged to heat the hydrocarbon fluids in the storage vessel; and
- a containment vessel supported on the base frame so as to fully surround the storage vessel so as to be arranged to contain any hydrocarbon fluids leaking from the storage vessel.

The may heater comprise (i) a heat exchanger vessel at least partially received within the storage vessel and containing a heat exchanger fluid therein, and (ii) a heat source received within the storage vessel and being arranged to heat the heat exchanger fluid, whereby the heat exchanger vessel functions as a secondary containment between the storage vessel and the heat source.

The combination of a heater within the storage vessel together with a surrounding containment vessel enables the contents of the storage vessel to be efficiently heated as the surrounding containment vessel together with the containment space between the source vessel and the surrounding containment vessel provides the function of an insulating layer about the heated contents of the storage vessel.

The heat exchanger vessel may include (i) a lower portion received within the storage vessel and (ii) an upper portion received within the storage vessel, in which the upper and lower portions are in communication with one another so as to define a continuous closed loop flow path for the heat exchanger fluid, and in which the heat source is received within the lower portion of the storage vessel so as to be arranged to heat the heat exchanger fluid in the lower portion.

In one embodiment, the heater comprises a burner tube communicating through a boundary wall of the containment vessel in sealed communication therewith. In this instance, the heater may comprise a burner supported externally of the containment vessel and connected to the burner tube to direct exhaust from the burner through the burner tube. A heat exchanger vessel containing a heat exchanger fluid therein preferably surrounds a portion of the burner tube that is within the storage vessel.

In an alternative embodiment, the heater may comprise an electrical heating element and a heat exchanger vessel containing a heat exchanger fluid therein and surrounding a portion of the electrical heating element that is within the storage vessel, in which the heat exchanger vessel communicates through the boundary wall of the containment vessel.

Preferably a boundary wall of the containment vessel is heat insulated and a boundary wall of the storage vessel is formed of a conductive material that is not heat insulated.

The structure may further include at least one flow line communicating through a boundary wall of the storage vessel from an inner end within an interior of the storage vessel to a terminal end coupled to a respective valve within an interior space defined by a boundary wall of the containment vessel, (ii) an access opening formed in the boundary wall of the containment vessel through which the valve at the outer end of said at least one flow line is accessible, and (iii) an access cover releasably mounted on the containment vessel in sealed relationship with the boundary wall of the containment vessel to close the access opening in a closed position of the access cover.

The access opening formed in the boundary wall of the containment vessel is preferably in alignment with the valve at the outlet end of said at least one flow line.

Preferably said at least one flow line communicates through the boundary wall of the storage vessel at an elevation spaced below a top side of the storage vessel.

A sight glass may be provided in communication with the containment space at an elevation of the access opening to determine if fluid within the containment space is above the elevation of the access opening before removing the cover.

Preferably the structure further includes a partition wall separating the interior space into an auxiliary valve space surrounding the valve at the terminal end of said at least one flow line and a containment space defined between the boundary wall of the storage vessel and the boundary wall of the containment vessel. In this instance the volume of the containment space is preferably greater than a volume of the storage vessel. The auxiliary valve space may be in communication with the containment space through a one-way valve in the partition wall. In some embodiments, the auxiliary valve space is recessed into an interior volume of the containment vessel.

According to a second aspect of the present invention there is provided a hydrocarbon fluid storage structure for storing hydrocarbon fluids therein, the structure comprising:

a base frame;

a storage vessel supported on the base frame so as to be arranged to contain hydrocarbon fluids therein;

a heater in communication with the storage vessel so as to be arranged to heat the hydrocarbon fluids in the storage vessel, the heater comprising:

a heat exchanger vessel containing a heat exchange fluid therein, the heat exchange vessel including a lower portion received within the storage vessel and an upper portion received within the storage vessel, the upper and lower portions being in communication with one another so as to define a continuous closed loop flow path for the heat exchanger fluid;

a heat source received within the lower portion of the storage vessel and being arranged to heat the heat exchanger fluid in the lower portion.

Preferably a flow of heat exchanger fluid along the closed loop flow path is driven solely by heating of the fluid.

Use of a heat exchanger vessel having upper and lower portions forming a closed-loop flow path with a heat source in the lower portion, allows the heat exchanger fluid to be passively recirculated for distributing the heat from the heat source over a much larger area of the heat exchanger vessel to optimize heat distribution from the heat source to the contents of the storage vessel.

Preferably a flow of heat exchanger fluid along the closed loop flow path is driven by heating of the fluid.

Preferably the upper portion of the heat exchanger vessel is sloped downwardly in a longitudinal direction from a first end to a second end of the upper portion, the first and second ends being in communication with the lower portion of the heat exchanger at spaced apart positions along the lower portion.

Preferably the source of heat communicates through a boundary of the heat exchanger vessel in proximity to the first end of the upper portion.

The heat source within the lower portion of the heat exchanger vessel may comprise a burner tube receiving exhaust gases from a burner.

Alternatively, the heat source within the lower portion of the heat exchanger vessel may comprise an electric heating element.

According to a further aspect of the present invention there is provided a hydrocarbon fluid storage structure for storing hydrocarbon fluids therein, the structure comprising:

a base frame;

a storage vessel supported on the base frame so as to be arranged to contain hydrocarbon fluids therein;

a containment vessel supported on the base frame so as to fully surround the storage vessel so as to be arranged to contain any hydrocarbon fluids leaking from the storage vessel;

at least one flow line communicating through a boundary wall of the storage vessel from an inner end within an interior of the storage vessel to a terminal end coupled to a respective valve within an interior space defined by a boundary wall of the containment vessel;

an access opening formed in the boundary wall of the containment vessel through which the valve at the outer end of said at least one flow line is accessible; and an access cover releasably mounted on the containment vessel in sealed relationship with the boundary wall of the containment vessel to close the access opening in a closed position of the access cover.

By providing flow lines in communication with the storage vessel in accessible alignment with an access opening in the boundary of the containment vessel, together with the access opening being able to be closed, ready access is provided for loading and unloading contents of the storage vessel, while still meeting requirements for secondary containment. By further providing a housing partitioned from the containment space but within an insulated envelope of the containment vessel boundary, any valves and couplings associated with the flow lines can be located in the partitioned housing so as to remain heated by residual heat from the contents of the storage vessel which further heat the containment space between the vessels and the partitioned space of the housing. This maintains optimal functionality of any valves and couplings associated with the flow lines even in colder climates.

BRIEF DESCRIPTION OF THE DRAWINGS

Some embodiments of the invention will now be described in conjunction with the accompanying drawings in which.

In the drawings like characters of reference indicate corresponding parts in the different figures.

DETAILED DESCRIPTION

Figure 1:
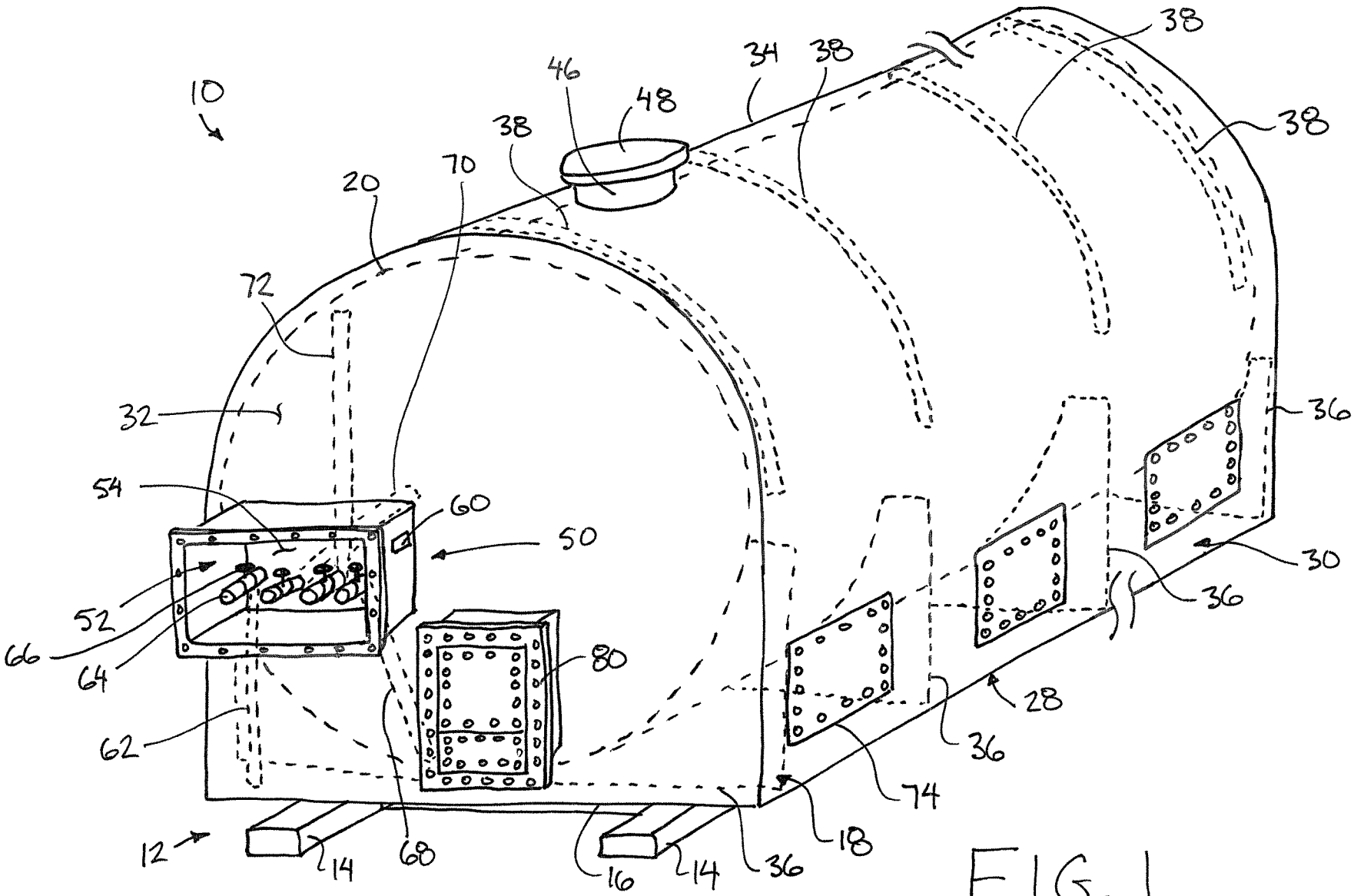
FIG. 1 is a perspective view of the storage structure according to the present invention.

Referring to the accompanying figures there is illustrated a hydrocarbon storage structure generally indicated by reference numeral 10. The storage structure 10 is particularly suited for storage of hydrocarbon fluids therein, for example produced fluids from a wellbore which may contain a mixture of liquid, gas and some solids at varying temperatures. More particularly the storage structure may be provided at a hydrocarbon wellbore site to directly receive produced fluids from the wellbore, and in which subsequent heating of the fluids is desirable to assist in gravity separation of the contents of the hydrocarbon fluid as well as to maintain fluidity of the fluids for subsequent transfer from the storage structure to the tank of a transport vehicle for example.

Although more than one embodiment is illustrated in the accompanying figures, the features in common with the various embodiments will first be described.

The structure typically comprises a base frame 12 defining a skid base suitable for handling and transport using various skid handling equipment, for example a winch truck, for loading the structure onto a transport vehicle and transporting the structure between various sites of use. The base frame 12 is elongate in a longitudinal direction of the structure and is primarily defined by two beams 14 extending the full length of the frame in the longitudinal direction at laterally spaced apart sides of the frame. The beams span the bottom side of the frame and are joined at longitudinally spaced apart positions by crossbars fixedly connected laterally between the beams. Crossbars 16 at opposing ends of the base frame may be adapted for connection to a winch cable for winching onto the deck of a winch truck for example.

The structure 10 generally includes a containment vessel 18 supported on the base frame and a storage vessel 20 received within the containment vessel such that the containment vessel provides secondary containment to any fluids stored within the storage vessel 20. The storage vessel 20 is fully received within the containment vessel 18 so as to define an enclosed containment space 22 between the inner boundary of the containment vessel and the outer boundary of the storage vessel.

In preferred embodiments, the storage structure 10 further includes a heater 24 received within the storage vessel 20 for heating contents of the storage vessel. The heater 24 is described in further detail below. In this instance an additional heat insulation layer 26 is provided to fully surround the external boundary of the containment vessel while the boundary of the storage vessel between the hollow interior of the storage vessel and the surrounding containment space remains uninsulated so that heat from contents within the storage vessel can readily migrate into the containment space for heating the containment space as well.

The containment vessel 18 includes a flat bottom floor 28 comprising a rigid rectangular sheet mounted above the longitudinal beams 14 of the base frame. Longitudinally oriented side walls 30 extend upwardly from laterally opposing sides of the floor along the full length thereof. The opposing ends of the vessel are enclosed by end walls 32 extending upwardly from opposing ends of the floor 28 so that the side walls and end walls extend about the full perimeter of the containment vessel. A semi-cylindrical top wall 34 is curved about a longitudinal axis of the vessel and is joined to the top ends of the side walls and end walls so that the floor and the walls collectively form a boundary wall of the containment vessel which fully encloses the containment space so that the containment space is suitable for containing fluids therein which may leak from the storage vessel.

The storage vessel 20 is received within the containment vessel and is generally cylindrical in shape about a longitudinal axis of the vessel. The storage vessel is supported spaced above the floor of the containment vessel by a plurality of saddles 36 at longitudinally spaced positions along the length of the storage vessel. Each saddle comprises a rigid plate oriented perpendicularly to the longitudinal direction, having a flat bottom edge abutted with the floor 28 across the full width thereof and a semicircular top edge within which the cylindrical boundary of the storage vessel is seated. The top wall 34 of the containment vessel is supported in close proximity to the top side of the cylindrical storage vessel 20 so as to define an even radial gap between the storage vessel in the semi-cylindrical top wall 34 of the containment vessel across the length and width of the structure.

A plurality of channels 38 are mounted within the radial gap between the top of the storage vessel 20 and the top wall 34 of the containment vessel in which each channel forms a rib extending in the circumferential direction about the storage vessel at longitudinally spaced apart positions from other channels. The space between the channels is open to the base between the bottom of the storage vessel 20 and the floor 28 of the containment vessel. Furthermore the bottom ends of the channels 38 are spaced above the top ends of the saddles 36 so as to define a flow space 40 therebetween communicating longitudinally along the full length of the structure so that the entire containment base 22 between the storage vessel and the containment vessel act as a single containment volume for receiving fluid leaking from the storage vessel 20.

To provide access to the interior of the storage vessel, a top access opening is provided in the top wall of the storage vessel. The access opening 42 is suitably sized to receive a person therethrough. A suitable collar surrounds the opening 42 to provide a seat for selectively receiving a lid 44 thereon such that the lid can be opened and closed relative to the top side of the collar about the opening. In the closed position, the lid is sealed relative to the collar which is in turn sealed relative to the top wall of the vessel to form part of the sealed boundary of the storage vessel that prevents communication of liquids therethrough.

The containment vessel 18 includes a corresponding collar 46 communicating through the top wall 34 thereof in alignment with the access opening 42 in the storage vessel. A lid 48 is hinged relative to the collar 46 to be operable between an opened position allowing access of a person therethrough to the access opening and a closed position in which the lid is sealed relative to the collar to prevent communication of fluids therethrough. The lid and the exterior of the collar include a portion of the heat insulation layer 28 thereon to form part of the heat insulated boundary about the containment space of the containment vessel.

The containment vessel is further provided with a valve housing 50 supported on a first end wall when a single storage vessel is provided within the containment vessel. If two storage vessels are provided longitudinally in series with one another within the containment vessel, a corresponding valve housing 50 associated with each storage vessel communicates through a respective end wall of the containment vessel.

The valve housing 50 defines boundary walls surrounding an auxiliary valve space 52 within the interior of the valve housing which is adjacent to the containment space 42 within the containment vessel. A portion of the end wall of the containment vessel enclosed by the valve housing 50 acts as a partition wall 54 between the containment space 22 and the auxiliary space 52 within the valve housing. A one-way valve 56 communicates through the partition wall to function as a drain at the bottom of the auxiliary space 52 which permits fluid flow therethrough only from the auxiliary space inward towards the containment space.

The partition wall 54 remains uninsulated and is formed of conductive metal such that heat within the containment space is readily transferred through the partition wall into the auxiliary valve space. The exterior walls of the housing 50 together with the exterior walls of the containment vessel form a collective outer boundary that is heat insulated and surrounds an interior space that combines the containment space 42 and the auxiliary valve space 52. In this manner, residual heat from the heated contents of the storage vessel function is readily transferred to the containment space and subsequently to the auxiliary valve space 52 while minimize heat loss to the exterior of the collective outer boundary of the structure.

An exterior opening in the valve housing supports a lid 58 thereon in which the lid is mounted about a perimeter of the exterior opening by a perimeter mounting flange permitting the lid to be fastened closed against the exterior opening. When lid is opened, the auxiliary space 52 is readily accessible by operators through the exterior opening; however, when the lid is closed, the lid forms part of the sealed boundary of the valve housing about the auxiliary space. Due to the valve communication through the partition wall between the auxiliary space 52 and the containment space, the boundary of the valve housing effectively comprises part of the perimeter boundary of the containment vessel for containing fluids therein.

A sight glass 60 is mounted in one of the boundary walls of the valve housing, or in the lid 58 thereof which maintains the sealed boundary of the housing while being sufficiently transparent to permit visual inspection of the interior of the valve housing by an operator at the exterior. In this instance, an operator can visually check to confirm that there is no fluid within the auxiliary space 52 before opening of the lid.

The valve housing 50 receives the outer ends of a plurality of flow lines in open communication with the interior of the storage vessel 20 and the outer end of an additional vacuum flow line 62 in open communication at the inner end thereof within the interior of the containment space adjacent the bottom end thereof. The opposing outer end of the vacuum flow line terminates within the valve housing 50. A shut off valve 64 is connected in series with the outer end of the vacuum flow line 62 within the interior of the valve housing 50. A suitable coupling 66 at the terminal outer end of the flow line provides a quick connection for coupling to external flow lines, for example the suction line of a vacuum truck for unloading contents from the containment space if required. The vacuum flow line communicates through the partition wall in sealed communication therewith.

The additional flow lines terminating within the valve housing 50 include (i) a lower flow line 68 having an inner end in open communication with the interior of the storage vessel adjacent the bottom end thereof, (ii) a middle flow line 70 having an inner end in open communication with the storage vessel at an intermediate location between the top and bottom ends thereof, and (iii) an upper flow line 72 having an inner end in open communication with the interior of the storage vessel adjacent the top end thereof. The outer ends of all of the flow lines terminate within the valve housing and are connected in series with a respective shut off valve 64 similarly to the vacuum flow line. Each flow line is further provided with a quick connect coupling 66 at the terminal end thereof within the valve housing to enable ready connection to external flow lines, such as a production line from a wellhead, or the discharge line connected to the storage tank of a transport vehicle. All of the flow lines are similarly communicated through the partition wall between the auxiliary space within the valve housing 50 and the containment space within the containment vessel in sealed communication with the partition wall such that the partition wall maintains a sealed boundary about the containment space. In this manner, the containment space remains sealed and contained even if the lid 58 of the valve housing is opened.

The partition 54 between the auxiliary space 52 of the valve housing and the interior containment space of the containment vessel remains uninsulated while the surrounding boundary walls of the valve housing 50 and the lid 58 of the valve housing are heat insulated to form part of the heat insulation layer 26. In this manner the boundary walls of the valve housing 50 form part of the heat insulating boundary fully surrounding the containment vessel 18 so that heat radiating from the fluid stored within the storage vessel assists in also heating the auxiliary space 52 within the valve housing containing the valve 54 and couplings 66.

A plurality of access openings with respective access panels 74 for closing the openings are formed in the side walls of the containment vessel in alignment with each of the sections within the containment space divided by the saddles 36. Each of the access openings receiving an access panel 74 thereon can be opened to receive an operator therethrough for cleaning out the respective section of the containment space. A suitable bolt flange is provided about each access opening to form a fastened connection about the full perimeter of each access panel 74 with an optional sealing gasket being provided therebetween to ensure that the access panels form a portion of the containment boundary of the containment vessel in a closed position.

The heater 24 includes a heat exchanger vessel 76 arranged to communicate through the first end of the structure by extending through an inner opening 78 in an end wall of the storage vessel and a corresponding outer opening 80 through the end wall of the containment vessel in alignment with the inner opening 78. Each of the inner and outer openings is provided with a perimeter flange about the opening enabling a bolted flange connection to the heat exchanger vessel about the perimeter of each opening such that the heat exchanger vessel is sealed across each of the openings at the bolt flanges and such that both openings are effectively closed by the heat exchanger vessel that occupies the opening in an installed configuration.

The heat exchanger vessel generally comprises a main tube 82 that extends longitudinally a majority or the full length of the storage vessel between opposing ends which are closed. The main tube 82 defines a lower portion of the overall heat exchanger vessel 76.

The heat exchanger vessel further includes a secondary tube 84 supported above the main tube 82 to define an upper portion of the heat exchanger vessel. The secondary tube 84 has an outer diameter which is smaller than the main tube, and it extends longitudinally from a first end 86 to an opposing second end 88 of the secondary tube. The first end 86 of the main tube is connected to a vertical riser tube 87 that communicates from the first end 86 of the secondary tube to the main tube with which it is in open communication therebelow. The secondary tube extends longitudinally at a downward slope from the first end to the second end thereof. The second end 88 is connected to an elbow in open communication with the main tube therebelow. In this manner the secondary tube 84 and the main tube 82 are connected to one another in a closed loop configuration to define a continuous cyclical path between the main tube and the secondary tube.

Figure 2:
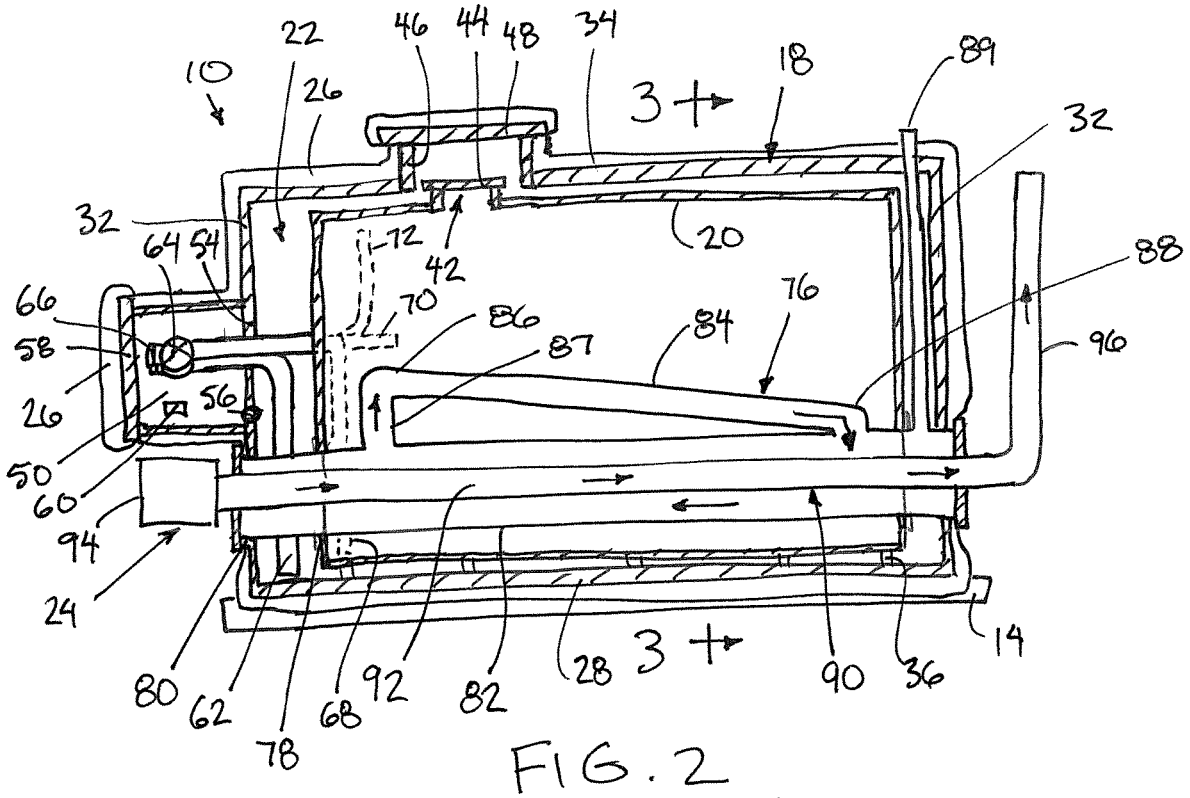
FIG. 2 is a partly sectional side elevational view of the storage structure according to FIG. 1 supporting a heater according to a first embodiment therein.
Figure 3:
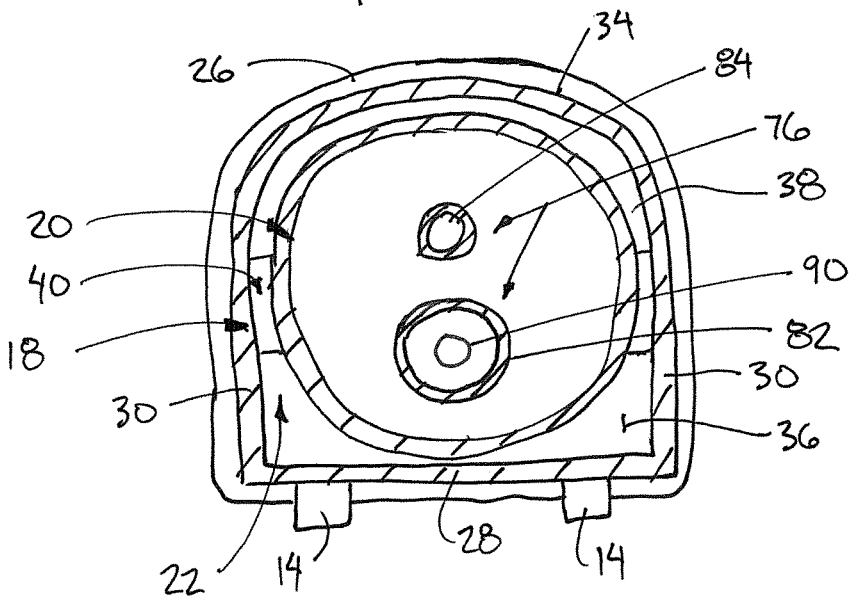
FIG. 3 is a sectional view along the line 3-3 in FIG. 2.
Figure 4:
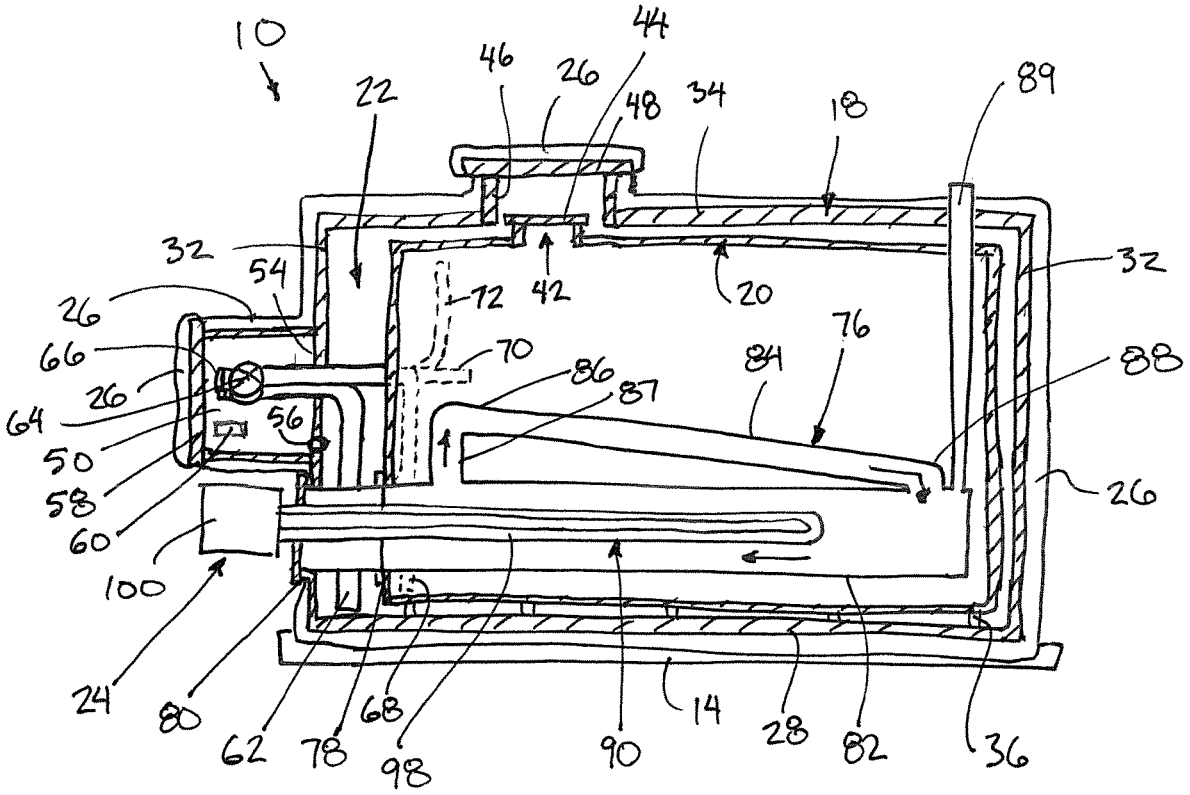
FIG. 4 is a partly sectional side elevational view of the storage structure according to FIG. 1 supporting a heater according to a second embodiment therein.

A heat exchanger fluid occupies the interior of the heat exchanger vessel 76. An expansion tube 89 is in communication between the main tube 82 adjacent the second end thereof to extend upwardly therefrom to exit through the top wall of the heat exchanger vessel. The expansion tube 89 may be provided within the interior of the storage vessel is represented in FIG. 4, or may be provided within the containment space as illustrated in FIG. 2. The expansion tube 89 provide space for the heat exchanger fluid to expand while ensuring that the heat exchanger vessel remains full of heat exchanger fluid as the heat exchanger fluid contracts in response to temperature changes.

The heater 24 further includes a heat source 90 received within the main tube 82 by mounting through the end wall at the first end of the main tube 82. The heat source 90 includes an external component for controlling the heat emitted from the heat source. Typically, the highest rate of heat delivery from the heat source occurs adjacent to the first end of the main tube and the secondary tube. The tendency of heat to rise causes an upward flow of the heat exchanger fluid in the riser 87 to drive a cyclical flow along the closed-loop path. The downward slope of the secondary tube 84 together with the transfer of heat from the heat exchanger fluid to the surrounding hydrocarbon fluids stored in the storage vessel that results in a cooling of the heat exchanger fluid within the secondary tube assists in driving the cyclical flow downward from the first end to the second end within the secondary tube. Fluid returns from the second end to the first end of the heat exchanger vessel within the main tube 82.

Turning now more particularly to the first embodiment shown in FIG. 2, in this instance the heat source 90 comprises a burner tube 92 extending fully through both ends of the storage structure between a first end in communication with an external burner 94 and a second end in communication with a vertical exhaust stack 96. In this manner, the external burner 94 combusts fuel therein and directs the products of combustion or exhaust from the burner through the burner tube 92 to be subsequently exhausted through the stack 96. The hot exhaust exchanges heat with the surrounding heat exchanger fluid along the length of the main tube 82 of the heat exchanger vessel. The cyclical flow within the heat exchanger vessel which is driven solely by the heating of the heat exchanger fluid results in redistribution of the heat from the heat exchanger fluid to the surrounding hydrocarbon fluids stored in the storage vessel across the larger boundary of the entire heat exchanger vessel.

In further embodiments, the secondary tube may not require a downward slope if the heating of fluid below the riser 87 is sufficient to drive flow up the riser. Likewise, the downward slope of the secondary tube may be sufficient to drive the cyclical flow in the heat exchanger vessel even if the heat source evenly heats the fluid in the main tube evenly along the length thereof.

In further embodiments, the heat exchanger vessel may be equipped with a pump to assist in circulating the heat exchanger fluid along the closed loop path to ensure efficient heat distribution.

Turning now more particularly to the second embodiment of the heater 24 shown in FIG. 4, in this instance the heat source 90 comprises an electrical heating element 98 extending from an external controller 100 at the first end of the structure. The heating element 98 spans a majority of the length of the heat exchanger vessel. As the heating element is not required to communicate with an exhaust stack, the opposing second end of the heat exchanger vessel in this instance may be fully contained within the storage vessel so that no communication of the heat exchanger vessel is required through the second end walls of the storage vessel and the containment vessel in this instance.

In further embodiments, the heat exchanger vessel 76 of the heater may be used in a variety of different storage vessels which may or may not be equipped with an integral secondary containment structure.

Figure 5:
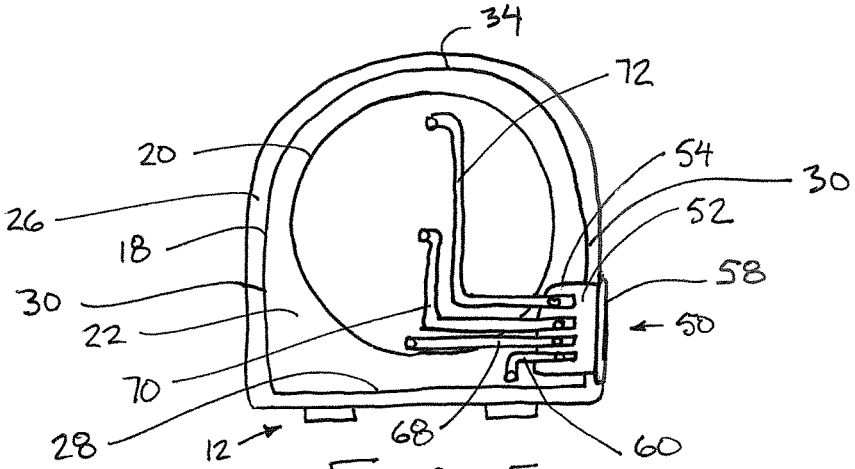
FIG. 5 is schematic end view of an alternative embodiment of the storage structure.

Turning now to FIG. 5, a second embodiment of the storage structure 10 is schematically represented. In this instance, the structure is substantially identical with regard to the placement of the storage vessel 20 within the surrounding containment vessel 18. The structure differs only in the placement of the valve housing 50 which in this instance is supported in one of the longitudinally extending sidewalls 30 of the containment vessel 18 so as to be recessed inwardly into the interior volume of the boundary shape of the containment vessel defined by the side walls 30, the end walls 32, the cylindrical top wall 34 and the floor 28. In this manner, the walls of the valve housing which surround the auxiliary valve space 52 within the housing all comprise partition walls 54 separating the valve space 52 from the containment space 22.

An open side of the valve housing 50 is provided at the exterior thereof in alignment with a corresponding access opening in the side wall 30 of the containment vessel. A perimeter flange about a perimeter of the open side of the valve housing supports the lid 58 of the valve housing thereon so that the lid is co-planar with and may be substantially flush with the surrounding sidewall 30 of the containment vessel. The lid 58 includes a layer of insulation thereon similar to the heat insulating layer 26 fully surrounding the exterior of the containment vessel 18.

The valve housing 50 in this instance is intended to be received longitudinally between two of the saddles 36 that support the storage vessel 20 within the containment vessel 18. The valve housing 50 is also situated in proximity to the bottom of the containment vessel so as to be received within a generally triangular space occupied between the cylindrical circumference of the storage vessel 20 and one of the bottom corners of the containment vessel where the floor 28 meets the side wall 30 in perpendicular relation thereto.

The valve housing 50 in this instance receives the shut off valves 64 and the couplings 66 of a similar set of flow lines including a vacuum line 62, a lower flow line 68, a middle flow line 70 and an upper flow line 72 which are identical to the corresponding flow lines of the previous embodiment.

The valve housing 50 is preferably located in proximity to one of the end walls of the structure 10 which is longitudinally opposed from the end wall that the heater 24 communicates through.

In further embodiments, the valve housing 50 may be mounted in one of the end walls which is opposite to the end wall supporting the burner 94 or the electric controller 100 thereon. The valve housing 50 may again be recessed inwardly into an interior volume defined by the boundary walls of the containment vessel by locating the valve housing to be longitudinally spaced between an end wall of the containment vessel and a corresponding end wall of the storage vessel.

Figure 6:
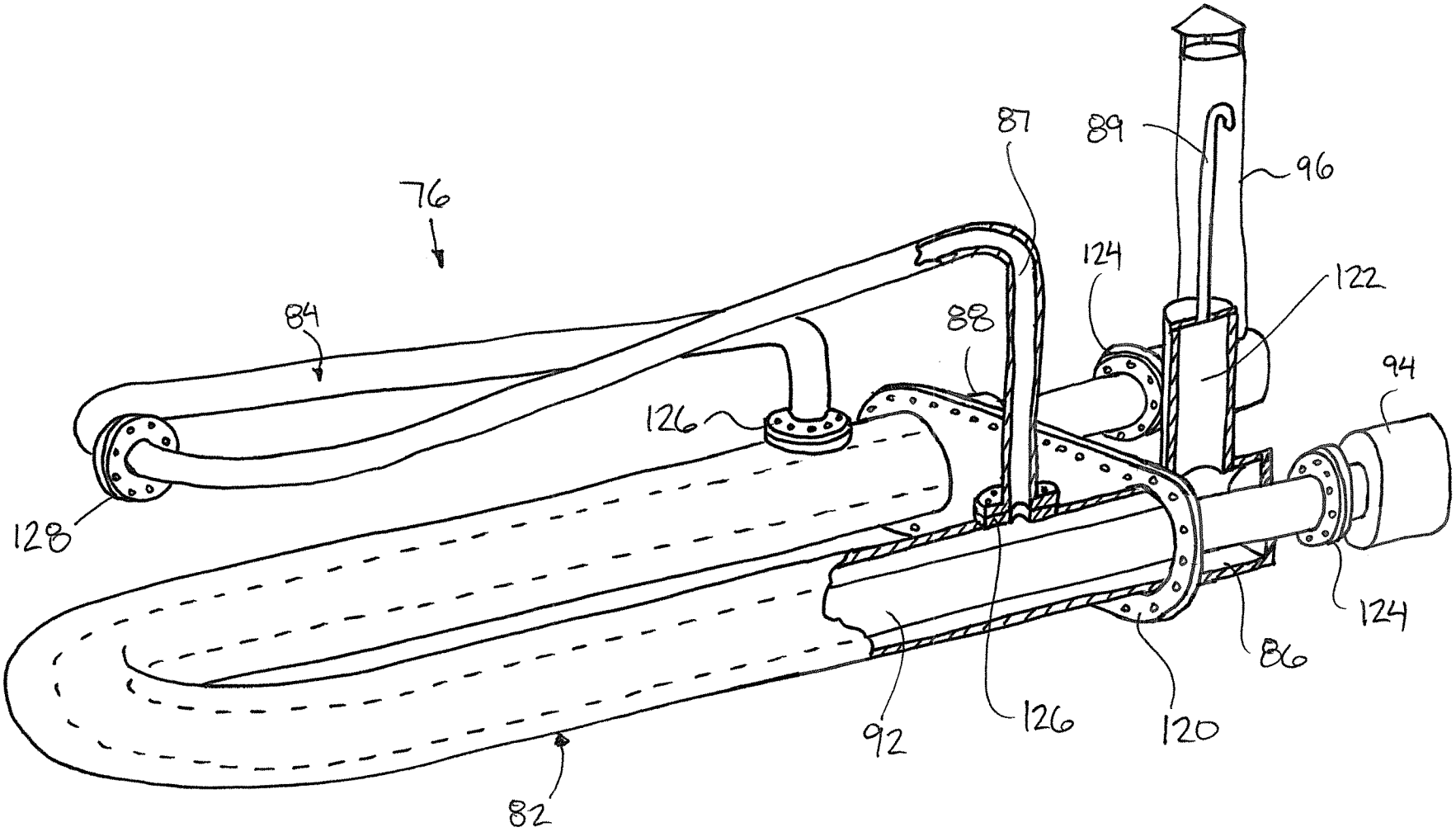
FIG. 6 is a perspective view of a further embodiment of the heater for use with either embodiment of the storage structure noted above.

Turning now to FIG. 6, a further embodiment of the heater is illustrated. In this instance, the heat source again comprises a burner tube 92 received within a heat exchanger vessel 76; however the burner tube 92 in this instance is generally U-shaped between the burner connection 94 at one end and the exhaust stack 96 at the other end so that both the burner 94 and the exhaust stack 96 are supported on the same end wall of the containment vessel 18.

The heat exchanger vessel 76 is configured such that the main tube defining the lower portion 82 is similarly U-shaped within a horizontal plane having opposing first and second ends 86 and 88 supported on a common mounting plate 120. The mounting plate 120 is elongate in a lateral direction and includes a perimeter edge which is arranged for forming a sealed connection to a corresponding perimeter flange about a common inner opening 78 within the end wall of the storage vessel 28. The inner opening 78 is similarly elongated in a lateral direction and matches the general shape of the perimeter edge of the mounting plate 120 so as to be suited for receiving insertion of the lower portion 82 of the heat exchanger vessel inserted into the storage vessel 20 through the inner opening 78.

The mounting plate 120 includes openings therethrough forming sealed connections with the corresponding first and second ends 86 and 88 of the main tube 82 of the exchanger vessel communicating therethrough. A first end portion at the first end 86 of the main tube extends beyond the mounting plate 120 into the containment space 22 within the containment vessel 18 for connection to a reservoir 122 extending upwardly from the main tube within the containment space. An expansion tube 89 extends upwardly from the reservoir and may communicate upwardly through the cylindrical top wall of the containment vessel while maintaining a sealed connection therebetween. In this manner, excess heat exchanger fluid can be stored in the reservoir and can expand up through the expansion tube to accommodate any volume changes of the heat exchanger fluid resulting from temperature change.

Alternatively, the first end portion of the main heat exchanger tube 82 may also communicate in sealed connection through the end wall of the containment vessel 18 so that the reservoir 122 and the expansion tube 89 are located externally of the containment vessel 18.

An opposing second end portion of the main tube 82 of the heat exchanger may terminate at the mounting plate 120, or may communicate through the mounting plate to terminate either within the containment space 22 or externally of the containment vessel by communicating in sealed relation through the end wall of the containment vessel 18.

The burner tube 92 in this instance is concentrically located within the main tube 82 and is reduced in diameter relative to the main tube 82 so that a gap is provided between the burner tube 92 and the surrounding main tube about the full circumference thereof and along the full length thereof. The gap is occupied by heat exchanger fluid so that heat transfer from the burner tube to the main tube and the surrounding contents of the storage vessel must be communicated through the heat exchanger fluid.

The first end of the burner tube 92 is situated externally of the containment vessel 18 by communicating in sealed relation through the end wall of the main tube 82 at the first end 86 thereof so that the burner 94 can be mounted externally of the containment vessel on the first end of the burner tube. The opposing second end of the burner tube is also situated externally of the containment vessel by communicating in sealed relation through the end wall of the main tube 82 at the second end 88 thereof so that an exhaust stack 96 connects with the second end of the burner tube and extends upwardly therefrom. Mounting flanges 124 may be provided to form a releasable connection through the end wall of the containment vessel 18 between the first end of the burner tube and the burner 94, and as well between the second end of the burner tube and the exhaust stack 96.

Similarly to the previous embodiment, the heat exchanger vessel 76 again comprises a secondary tube 84 forming an upper portion of the heat exchanger vessel which is in a closed loop configuration together with the main tube 82. The secondary tube 84 includes a riser tube 87 extending upwardly from the main tube 82 in proximity to the first end of the main tube at a location within the interior of the storage vessel 20. The riser tube 87 is connected in communication with the mounting location on the main tube 82 using a set of mounting flanges 126.

The secondary tube 84 follows the U-shaped path of the main tube 82 at a location spaced above the main tube. The secondary tube 84 is sloped gradually downwardly from a first end in communication with the top of the riser tube 87 to an opposing second end in communication with the main tube 82 at a location in proximity to the second end 88 thereof while remaining within the interior of the storage vessel. The second end of the secondary tube 84 also connects to the main tube by a flanged connection 126. A short riser that is shorter than the riser tube 87 may be used to communicate between the second end of the secondary tube and the main tube to ensure the secondary tube remains spaced above the main tube along the length thereof between the opposing first and second ends.

An intermediate flanged connection 128 may be provided at an intermediate location along the length of the secondary tube 84 to allow the secondary tube to be assembled together and coupled to the main tube subsequent to insertion of the main tube into the interior of the storage vessel 20 during assembly.

Once assembled, similarly to the previous embodiment, the secondary tube 84 forms a closed loop with the main tube 82. Due to the proximity of the riser tube 87 to the burner 94, the heat exchanger fluid is heated to the greatest degree within the main tube 82 in proximity to the first end thereof so that the heated fluid rises naturally through the riser tube 87 to induce a circulating flow in the closed-loop configuration of the main tube 82 and the secondary tube 84. As the heat exchanger fluid within the secondary tube 84 loses heat by transfer of heat to the surrounding contents of the storage vessel, the heat exchanger fluid naturally falls downwardly along the slope from the first end to the second end thereof and returns into the main tube at the second end of the main tube nearest to the exhaust stack 96. The returning fluid entering into the main tube thus encourages a continuing flow from the second end of the main tube towards the first end thereof to replenish the heated fluid rising up through the riser tube 87.

When using a heat exchanger vessel 76 as illustrated in FIG. 6, with both the burner 94 and the exhaust stack 96 located at the same end of the containment vessel, the valve housing 50 is preferably supported in proximity to the opposing end of the containment vessel, either within the end wall of the containment vessel 18 or within one of the longitudinal side walls 30 of the containment vessel in proximity to the end of the containment vessel opposite from the burner 94 and exhaust stack 96.

In further embodiments, an electric heating element 98 may be used within a heat exchanger vessel 76 which is arranged in a U-shaped configuration according to FIG. 6, but without the need for a burner tube 92, a burner 94 or an exhaust stack 96.

The storage structure 10 has many advantages when compared to a typical oilfield tank including the following:

(i) No Containment Required—The double wall design (including the vault, manway and heater) includes 140% containment and reduces the total installed cost. Environmental impact is reduced since the containment is not open to the elements or wildlife.

(ii) Safe, Low Cost Transport—The low-profile design eliminates permits, hydraulic cradle trucks, pilot cars and picker trucks. A winch trailer is all that is required for most installs.

(iii) Low Operating Costs—High efficiency (up to 91%) indirect heater combined with insulation and an air-filled interstitial space keep heating costs down. This also reduces emissions.

(iv) The Safest Option Available. No containment walls to step over. Low overall height improves access and reduces risk for operations and maintenance. Low heater skin temperatures eliminate tube failures and low-level fluid risks.

(v) High Process Efficiency—The horizontal flow, combined with the indirect heating system allows the structure 10 to perform more like a treater than a traditional wellhead tank. Each tank is designed to operate at a containment pressure of 16 oz/in2 to accommodate vapor recovery.

(vii) Suitable for Sensitive Fluids—The indirect heating system provides a large surface area, but low peak skin temperatures to make it suitable for light oil, water and oils containing polymer. This skin temperature is controlled by the BMS and can be adjusted by the customer.

With regard to the heat exchanger vessel of the heater, although it looks similar to an old style firetube traditionally used in heavy oil, appearance is where the similarity ends. A traditional direct fired firetube uses a flame to heat the steel surface of the tube which directly heats the process fluid.

By contrast, the heater according to the present invention heats the process fluid indirectly by adding a heat transfer fluid and a second layer of steel. Heat is first transferred through the inner heating surface into the heat transfer fluid. It is then transferred from the heat transfer fluid through the outer heating surface into the process fluid.

One of the key parts of the heat exchanger vessel is the recirculation loop. When the heat transfer fluid begins to heat up, natural convection forces it up into the recirculation loop. The fluid travels through the loop and re-enters the cold end (stack side) of the heater. The purpose of the loop is to provide additional surface area, as well as to normalize temperatures throughout the heater.

A conventional firetube has an extremely large temperature gradient from the burner to the stack. To illustrate this, a 300,000 BTU/hr industrial burner was placed in a standard firetube and ran for 20 minutes in open air to allow the temperatures to reach steady state. The results of the experiment were that, while the temperature at the burner has reached 367 degrees Celsius, most of the tube surface is less than 100 degrees Celsius, and the entire return leg is closer to 50 degrees Celsius. This variability causes the following problems:

(i) The high temperature at the burner can be above the auto-ignition temperature of some fluids. This is why firetubes are not allowed in light oil applications.

(ii) Tube failures typically occur at the burner because the high temperature weakens the steel. These temperatures can also cause additional process problems. For example, oil, sand and polymer can bake onto the tube creating a layer of insulation. This layer prevents heat transfer, causing the steel temperature to increase further, often leading directly to failure.

(iii) Differential heating of the hot and cold legs induces stresses in the firetube miters. Combined with thermal cycling, this can also cause failure over time.

(iv) The process is not heated evenly. In almost all situations it is preferable to provide even heat across a wide area rather than concentrated in a small area.

In a second experiment, the same 300,000 BTU/hr burner was then placed into a heat exchanger according to the present invention for 20 minutes allowing temperatures to reach steady state. In this experiment a "straight through" version is mounted in a horizontal tank according to FIG. 2, rather than the "U-type" shown in FIG. 6. Both versions operate identically and, except for the 180-degree bend in the middle, are believed to operate the same. When compared to the firetube, the results found that the maximum skin temperature is drastically lower at 71 degrees Celsius instead of 367 degrees Celsius, while being far more uniform and consistent across the entire surface of the heat exchanger, which most of the heat is being provided by the recirculation loop. The low skin temperatures and even heat distribution of the heat exchanger of the present invention provide a number of advantages vs conventional firetubes.

(i) Safety. The low skin temperatures allow the system to be used safely in more volatile fluids. Skin temperatures can also be adjusted using the temperature controller in the heat transfer fluid. In addition, every heat exchanger system includes the following: CSA B149.3 compliant burner piping c/w Field Approval; Class 1, Zone 2 compliant Burner Management System; Inlet mounted aluminum cell Flame Arrestor; High Temperature Shut-Down (Bath); High Temperature Shut-Down (Heat Transfer Fluid); Low Level Shut-Down (Bath); and Low Level Shut-Down (Heat Transfer Fluid).

(ii) Reliability. Because of the low skin temperatures, the risk of baking on production solids, asphaltenes or polymer is eliminated or greatly reduced, as is the possibility of tube failure. This also improves the effectiveness of cleaning systems such as spray nozzles etc.

(iii) Efficiency. During development, a 1200 bbl tank fitted with the heat exchanger was filled with water and the heater was turned on. Over the length of the test it was determined that 91% of the available heat was transferred to the water. This is much higher than the 50%-60% commonly associated with firetubes.

(iv) Environment. Most leaks through a firetube occur when it fails. Because the heat exchanger is so much more reliable, these leaks are virtually eliminated. Also, because it is an indirect system, there are two barriers between the process fluid and the environment providing an additional level of safety. In addition, the heat transfer fluid used in the heat exchanger is environmentally friendly and biodegradable.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A hydrocarbon fluid storage structure for storing hydrocarbon fluids therein, the structure comprising:

a base frame;

a storage vessel supported on the base frame so as to be arranged to contain hydrocarbon fluids therein;

a heater in communication with the storage vessel so as to be arranged to heat the hydrocarbon fluids in the storage vessel; and a containment vessel supported on the base frame so as to fully surround the storage vessel;

the storage vessel being fully received with a boundary of the containment vessel;

a containment space that is fully enclosed between a boundary of the storage vessel and the boundary of the containment vessel such that the containment space is arranged to contain fluid therein;

wherein the boundary of the storage vessel is uninsulated such that the containment space is arranged to be heated by heat migrating from hydrocarbon fluids contained in the storage vessel into the containment space; and wherein the boundary of the containment vessel is heat insulated so as to be arranged to contain heat within the containment space.

2. The structure according to claim 1 wherein the heater comprises:

a heat exchanger vessel at least partially received within the storage vessel and containing a heat exchanger fluid therein; and a heat source received within the storage vessel and being arranged to heat the heat exchanger fluid.

3. The structure according to claim 1 wherein the heater comprises a burner tube communicating through a boundary wall of the containment vessel in sealed communication therewith, the burner tube being arranged to be connected to a burner supported externally of the containment vessel and being arranged to receive exhaust from the burner directed through the burner tube.

4. The structure according to claim 3 further comprising a heat exchanger vessel containing a heat exchanger fluid therein and surrounding a portion of the burner tube that is within the storage vessel.

5. The structure according to claim 2 wherein the heat exchanger vessel includes (i) a lower portion received within the storage vessel and (ii) an upper portion received within the storage vessel, wherein the upper and lower portions are in communication with one another at two spaced apart locations so as to define a continuous closed loop flow path comprising a continuous recirculating loop within which the heat exchanger fluid is arranged to be continuously recirculated, and wherein the heat source is received within the lower portion of the storage vessel so as to be arranged to heat the heat exchanger fluid in the lower portion.

6. The structure according to claim 1 wherein the heater comprises an electrical heating element and a heat exchanger vessel containing a heat exchanger fluid therein and surrounding a portion of the electrical heating element that is within the storage vessel, the heat exchanger vessel communicating through the boundary wall of the containment vessel.

7. The structure according to claim 1 further comprising (i) at least one flow line communicating through the boundary wall of the storage vessel from an inner end within an interior of the storage vessel to a terminal end coupled to a respective valve within the containment space defined by the boundary wall of the containment vessel, (ii) an access opening formed in the boundary wall of the containment vessel through which the valve at the outer end of said at least one flow line is accessible, and (iii) an access cover releasably mounted on the containment vessel in sealed relationship with the boundary wall of the containment vessel to close the access opening in a closed position of the access cover.

8. The structure according to claim 7 wherein the access opening formed in the boundary wall of the containment vessel is in alignment with the valve at the outlet end of said at least one flow line.

9. The structure according to claim 7 wherein said at least one flow line communicates through the boundary wall of the storage vessel at an elevation spaced below a top side of the storage vessel.

10. The structure according to claim 7 further comprising a sight glass in communication with the containment space at an elevation of the access opening.

* * * * *